US005492254A

United States Patent [19]

Challoner et al.

[11] Patent Number: 5,492,254

[45] Date of Patent: Feb. 20, 1996

[54] CARRIER CASE FOR RECREATIONAL BOARDS

[76] Inventors: Audrey Challoner, 399 W. Broadway, New York, N.Y. 10012; Michael Swick, 53 W 70th 3A, New York, N.Y. 10023

[21] Appl. No.: 231,825

[22] Filed: Apr. 25, 1994

Related U.S. Application Data

[62] Division of Ser. No. 941,666, Sep. 8, 1992, Pat. No. 5,344,056.

[51] Int. Cl.[6] ..... A45C 15/00

[52] U.S. Cl. ..... 224/151; 224/202; 224/203; 224/257

[58] Field of Search ..... 224/149, 150, 224/202, 203, 205, 207, 257, 151, 153, 191, 209, 214

[56] References Cited

U.S. PATENT DOCUMENTS

| | | | |
|---|---|---|---|
| 4,793,535 | 12/1988 | Johnson | 224/329 |
| 5,092,506 | 3/1992 | Bolduc | 224/209 |
| 5,104,017 | 4/1992 | Vandoginee | 224/205 |

*Primary Examiner*—Henry J. Recla
*Assistant Examiner*—David J. Walczak

[57] ABSTRACT

A carrier case for carrying a recreational board such as a skateboard, snowboard, surfboard or the like. The carrier case has a base and a first and second engagement pounch or compartment for securing a recreational board to the base.

1 Claim, 4 Drawing Sheets

CARRIER CASE FOR RECREATIONAL BOARDS

This is a divisional application of application Ser. No. 07/941,666, filed Sept. 8, 1992, now U.S. Pat. No. 5,344,056.

BACKGROUND OF THE INVENTION

The field of the present invention is carrier cases for recreational boards such as skateboards, surfboards, snowboards and the like.

A convenient way to carry or transport a recreational board is needed that allows skateboarders, surfers and snowboarders to transport or carry their boards while leaving their hands free to carry other articles. For example, a surfboard is a large and bulky item that sometimes, depending upon its size, requires two hands to balance and carry the board from the surfer's car to the beach. Without a carrier case, a surfer must make several long trips to and from a car parked in a parking lot or on the road to the water in order to transport his surfboard, ice cooler, blanket or towels, and other surfing accessories. Needless to say, the surfer would rather make fewer trips rather than spend his time and energy walking back and forth across the sand to his car in order to load and unload his belongings. Similarly, many surfers with smaller boards ride their bicycles to the beach and carry their boards under one arm while steering the bicycle with the other. This is often done during the early hours of the morning in order to catch the incoming high tide. Needless to say, this is not a safe practice. In all of these situations, a carrier case that can be used to hold a recreational board on the wearer's back leaving his hands free is highly desirable.

Along the same lines, a snowboarder usually has several bags of luggage to load into her car, carry through an airport, and/or unload into a mountain chalet. Often, the snowboarder also has a pair of skis and related accessories that she is also taking on her ski vacation. Without a carrier case for the snowboard, the snowboarder must carry the snowboard under one arm while carrying other articles in the other. This is not only awkward, but also means that she will inevitably have to make several trips to load and unload the rest of her belongings. Again, in these situations a carrier bag that can be used to hold a recreational board on the user's shoulder's is or back leaving her hands free is highly desirable.

Another instance when a recreational board carrier case is desired is when a skateboarder wishes to enter a store or mall to go shopping or to get something to eat or drink. He may want to use a carrier case to carry his skateboard around in the shopping mall rather than holding it in his hands. However, to have a carrier case available in such a situation means that he needs a carrier case that is easy to carry when not in use (for example, when the skateboarder is skating to the mall). In other words, a recreational boarder does not want a carrier case that is awkward to carry while riding on a skateboard or snowboard. A carrier bag that is lightweight, easy to use, easy to carry when not in use, and that leaves the recreational boarder's hands free is, therefore, highly desired.

SUMMARY OF THE INVENTION

The present invention is directed to a carrier case for carrying a recreational board such as a skateboard, snowboard, surfboard and the like. To this end, a carrier case comprising a base having a proximate and distal end, and a first engagement means and a second engagement means for securing respective proximate and distal ends of the recreational board to the base is disclosed.

Accordingly, it is an object of the present invention to provide a carrier case for recreational boards that will allow the user to hold a recreational board on his or her shoulder or back leaving his or her hands free.

Another object of the present invention is to provide a carrier case for a recreational board that, when not in use, can be folded or rolled into itself to provide a carrier pouch or the like that the user can wear on his or her waist, shoulder or back leaving his or her hands free.

Other and further objects and advantages of the disclosed invention will appear hereinafter.

DETAILED DESCRIPTION OF THE PREFERRED EMBODIMENT

Figure 1:
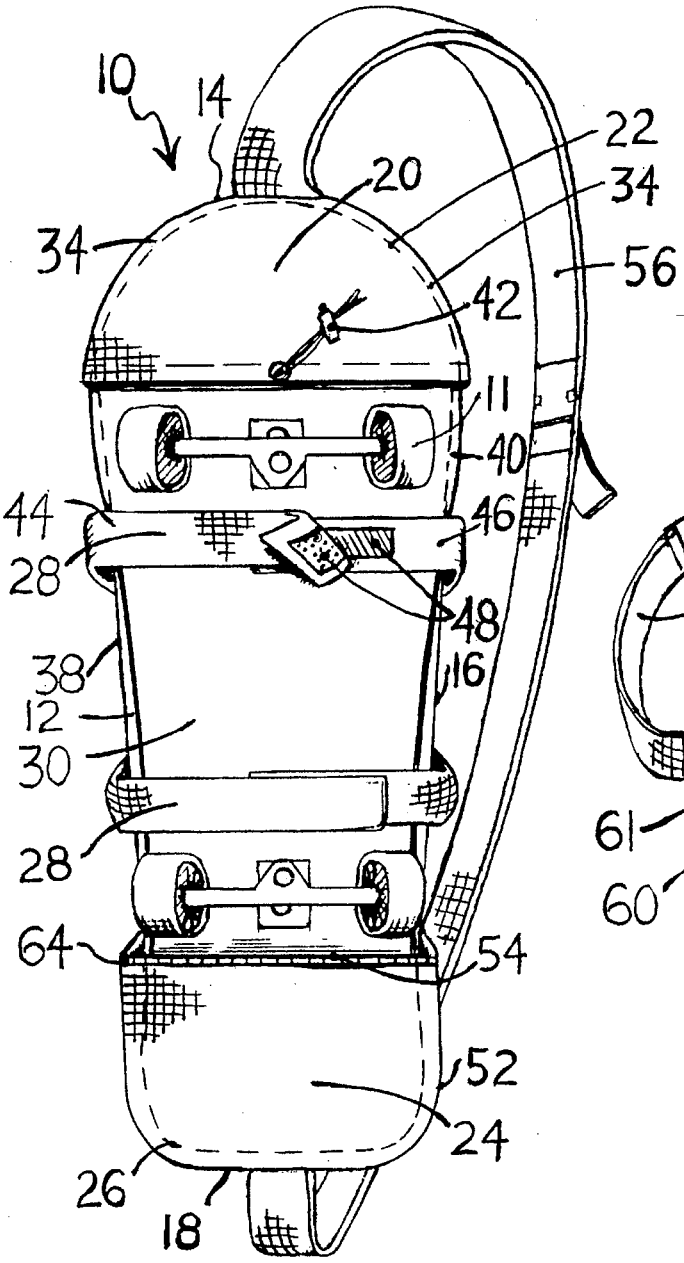
FIG. 1 is a perspective front view of a carrier case for carrying a skateboard.

Turning in detail to the drawings, a carrier case 10 for carrying a recreational board such as a skateboard 11 is shown comprising a base 12 having a proximate end 14, a midsection 16, and a distal end 18. The carrier case 10 also includes a first board engagement means 20 for holding a proximate end 22 of a recreational board 11 in contact with the proximate end 14 of the base 12, a second board engagement means 24 for holding a distal end 26 of the recreational board 11 in contact with the distal end 18 of the base 12, and a third engagement means 28 for holding the midsection 30 of the recreational board 11 in contact with the midsection 16 of the base 12. The base 12 is also comprised of a front of face side 17 and a rear or back side 19.

Figure 2:
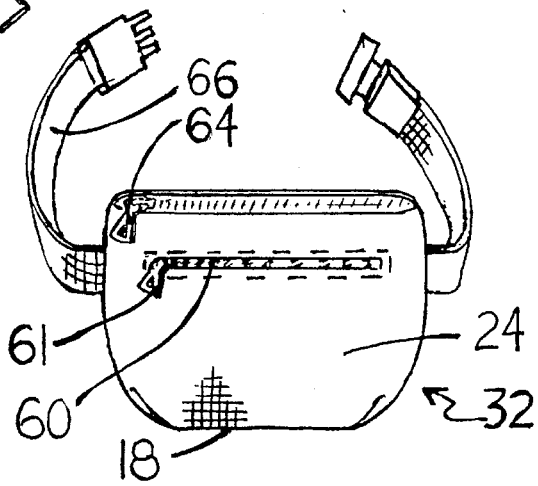
FIG. 2 is a perspective front view of the carrier case in FIG. 1 folded up into itself to produce a small compartment such as a fanny pack that can be carried around the wearer's waist.
Figure 5:
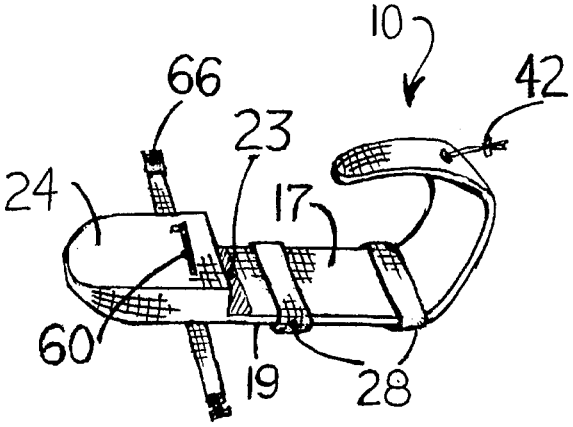
FIG. 5 is a perspective front view of the carrier case shown in FIG. 1 in a semi-folded position.
Figure 6:
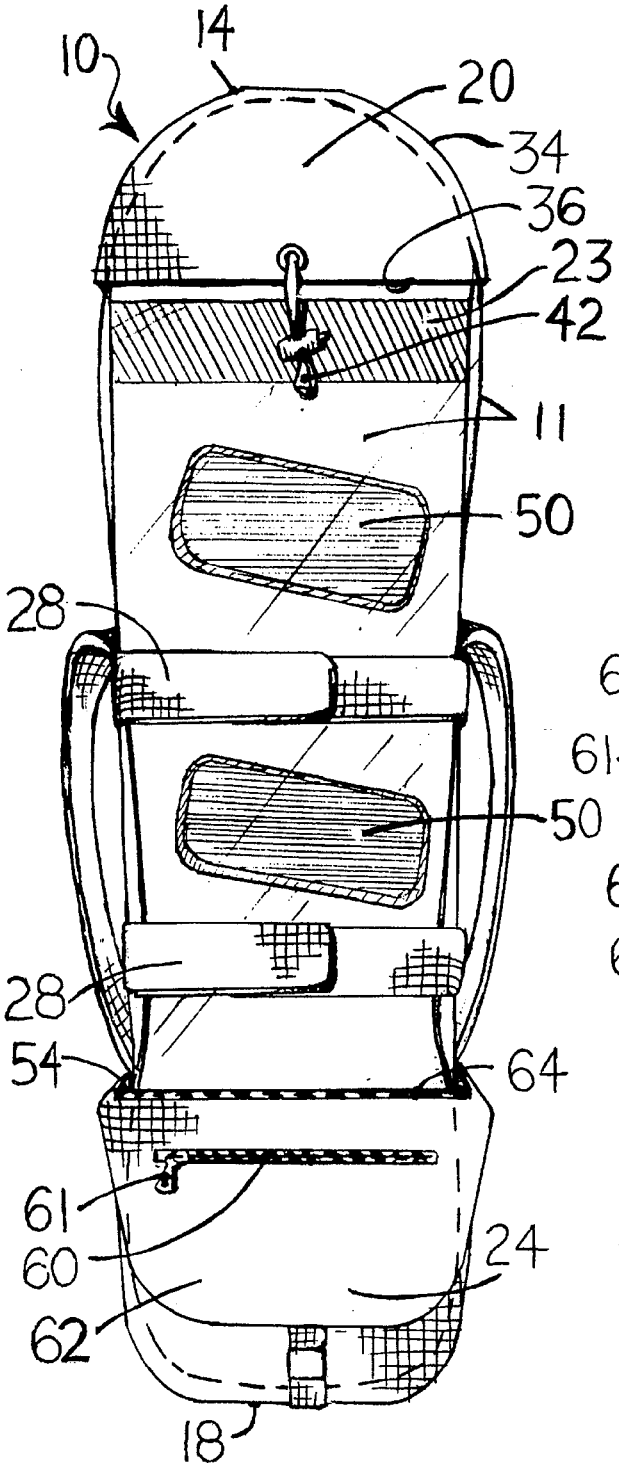
FIG. 6 is a perspective front view of a second embodiment of a carrier case for carrying a snowboard.
Figure 7:
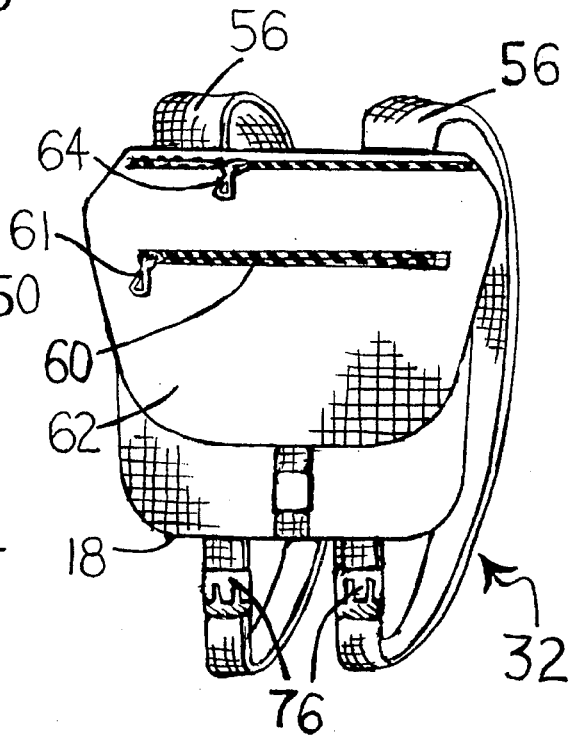
FIG. 7 is a perspective front view of the carrier case shown in FIG. 6 folded up into itself to produce a compartment that can be carried on the wearer's back.
Figure 8:
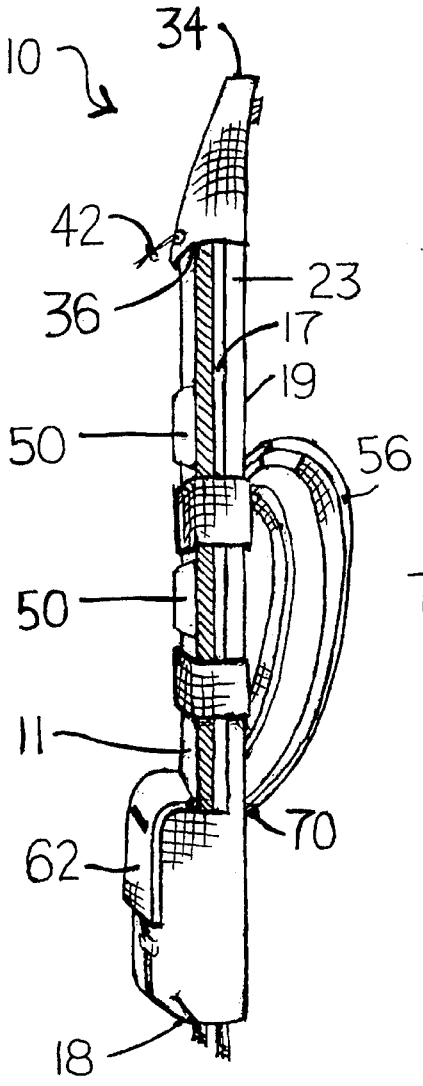
FIG. 8 is a perspective side view of the carrier case shown in FIG. 6.
Figure 9:
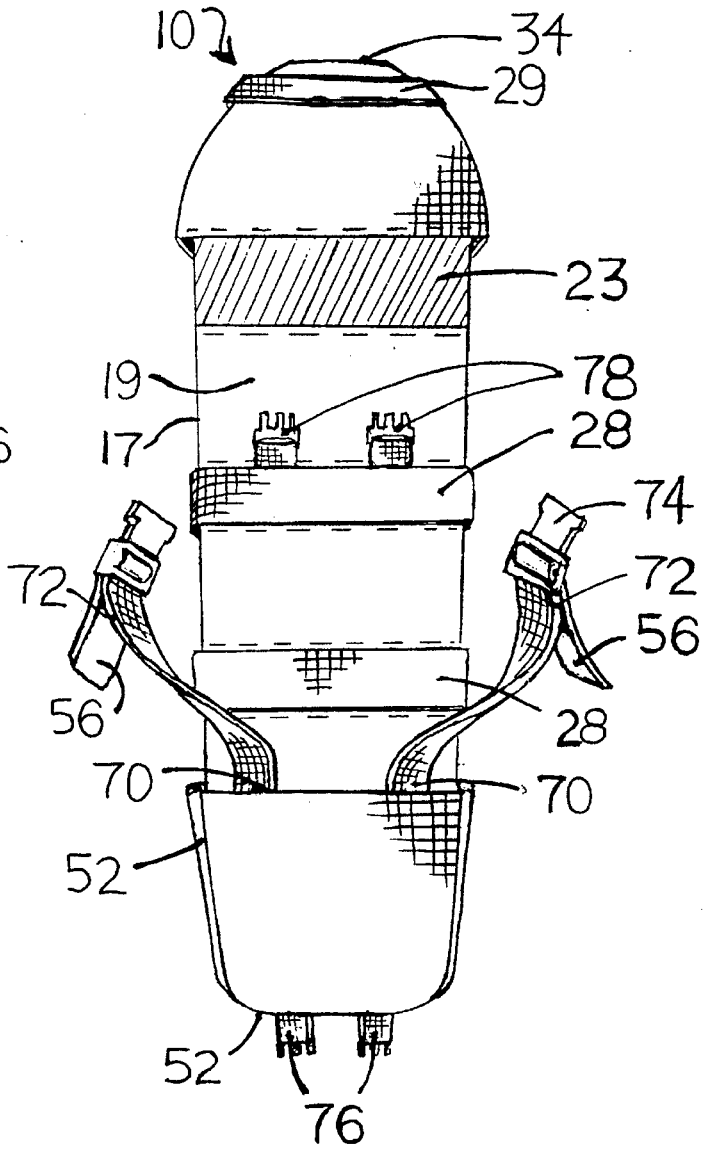
FIG. 9 is a perspective rear view of the carrier case shown FIG. 6.

The carrier case 10 may be made of a sturdy, lightweight, flexible material such as canvas, nylon or other synthetic natural fiber. One important feature to consider when selecting an appropriate material is that the preferred embodiment of this invention is capable of folding into itself to form a carrier pouch or compartment 32, as illustrated in FIGS. 2, 5 and 7, that can hold a substantial portion of the carrier bag 10 therein to allow the user to conveniently carry the carrier bag 10 around the user's or wearer's waist or shoulder or on the wearer's back depending upon the size of the carrier pouch 32.

The base 12 is a flat piece of material having an oblong shape that is substantially similar to the shape of the recreational board 11 it is designed to carry. It does not necessarily have to be the same size, nor does it have to be larger even though that might be desired in some cases. In some instances, however, the base 12 may be smaller than the recreational board such as when an elastic material is used for the midsection (or in place of the midsection) 16. An elastic material(23 FIGS. 4–6,9) will allow a particular carrier case 10 to fit a variety of shaped recreational boards 11 and may also hold the recreational board more securely and firmly because the first engagement means 20 and second engagement means 24 will be biased towards each other thereby pulling the carrier case 10 tightly around the recreational board 11. As illustrated in FIG. 1, the proximate end 14 of the base 12 is curved and somewhat crescent or domed shaped while the distal end 18 of the base 12 is relatively straighter and shaped somewhat like a parallelogram. The midsection 16 of the base 12 (generally, the portion of the base anywhere in between the distal and proximate ends), although generally shaped like a parallelogram, may take any number of shapes. In addition, the midsection 16 can be comprised of one or more longitudinal strips of material (not shown) connecting the distal end 18 of the base 12 with the proximate end 14 of the base 12.

The first engagement means 20 is a pouch or compartment that can be formed by securing the outer edge 34 of a strip of material along the outer edge of the proximate end 14 of the base 12 and leaving an inner edge 36 of the material unsecured to form an opening to receive an end of the skateboard. In FIG. 1, the strip of material is substantially shaped to coincide with the proximate end 14 of the base 12 having a first curved or domed shape outer edge or side 34 and a second straight inner edge or side 36. The outer edge 34 is sewn or otherwise secured to the outer edge of the base 12. The inner edge 36, which is not secured to the base 12, faces and opens toward the distal end 18 of the base 12. In this way, a pocket or compartment is formed to hold and receive one end of the skateboard. However, it should be noted that it is not necessary for the first engagement means 20 to be in the form of a pouch that opens only along the inner edge 36. The first engagement means 20 can also be a strap (not shown) positioned across the proximate end 14 of the base 12 (for example, from a left side 38 of the base to a right side 40 of the base). Opposite ends of the strap can be sewn or otherwise secured along the outer edge of the proximate end 14 of the base 12 similar to the way the third engagement means 28 is secured in FIG. 1. Thus, two edges of the first engagement means would open to accept the skateboard.

The first engagement means 20 can also include a drawstring 42 or other mechanism to tighten the inner edge 36 around the recreational board. Such a mechanism is useful to help prevent the engagement means from slipping off the end of the skateboard.

The third engagement means 28 is comprised of a first strap 44 having a first end secured to the left outer edge 38 of the base and a second end for engagement with a second strap 46 which has a first end which is secured to the right outer edge 40 of the base and a second end which engages the first strap 44. Each strap has a strap connecting means 48 for connecting or locking the straps together around the skateboard. Although FIG. 1 shows the strap connecting means 48 as a Velcro or hook and loop fastener system other means such as a buckle, drawstring, clip mechanism or the like are also contemplated and acceptable. In addition, longer straps or strings can be used and tied in a knot in order to connect them together around the recreational board. As shown in FIGS. 1, 3–6 and 8–9, the third engagement means 28 can be a plurality of strap arrangements strategically positioned in the midsection 16 of the base 12 to hold the skateboard in substantial contact with the base 12. As illustrated in the drawings, the straps 28 are positioned such that they avoid contact with the wheels on the skateboard or the bindings 50 on the snowboard to provide a relatively flat relationship between the straps and the recreational board 11. In addition a hand strap or handle can also be provided 29 (FIG. 9) to assist in applying and removing carrier case.

The second engagement means 24 is a pouch or compartment which can be formed by securing outer edges 52 of a section of material along the outer edge of the distal end 18 of the base while leaving an inside edge 54 facing the proximate end 14 of the base 12 unsecured. The shape of the section of material substantially coincides with the shape of the distal end 18 of the base 12. The unsecured inside edge 54 and the base 12 form an opening into the compartment or pouch 24 in order to receive one end of a skateboard or, when the carrier case is folded up, to receive the portion of the base or carrier case extending from the inner edge 54 to the proximate end 14 of the base 12.

A shoulder strap 56, either permanently or removably attached to the carrier case 10 is also provided so that the user can carry the skateboard over his shoulder when it is encased in the carrier case 10. The shoulder strap 56 has one end attached to the distal end 18 of the carrier case 10 and a second end attached to the proximate end 14 of the carrier case. However, the shoulder strap 56 can also be attached anywhere on the base 12.

The second engaging means 24 also serves as a compartment or carrier pouch 32 for carrying the carrier case 10 when it is not in use. As illustrated in FIGS. 2 and 5, the upper portion of the carrier case (the midsection 16 and the proximate end 14) can be folded or rolled up so that it fits into the second engagement means 24. The carrier pouch 32 can also be provided with additional pockets or storage space 60 having a zipper 61 or a flap 62 to cover the storage space entrance. A zipper 64 is also provided to close the carrier pouch 32 after the carrier case 10 has been rolled up and placed therein. The carrier pouch 32 also provides a waist belt 66 so the user can carry the pouch 32 around his waist leaving his hands free to carry other items or to assist in keeping his balance while riding the skateboard.

Figure 3:
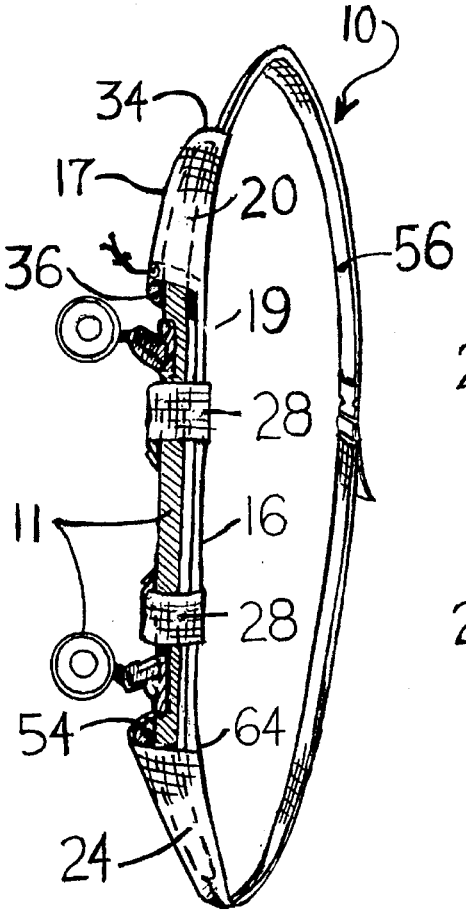
FIG. 3 is a perspective side view of the carrier case shown in FIG. 1.
Figure 4:
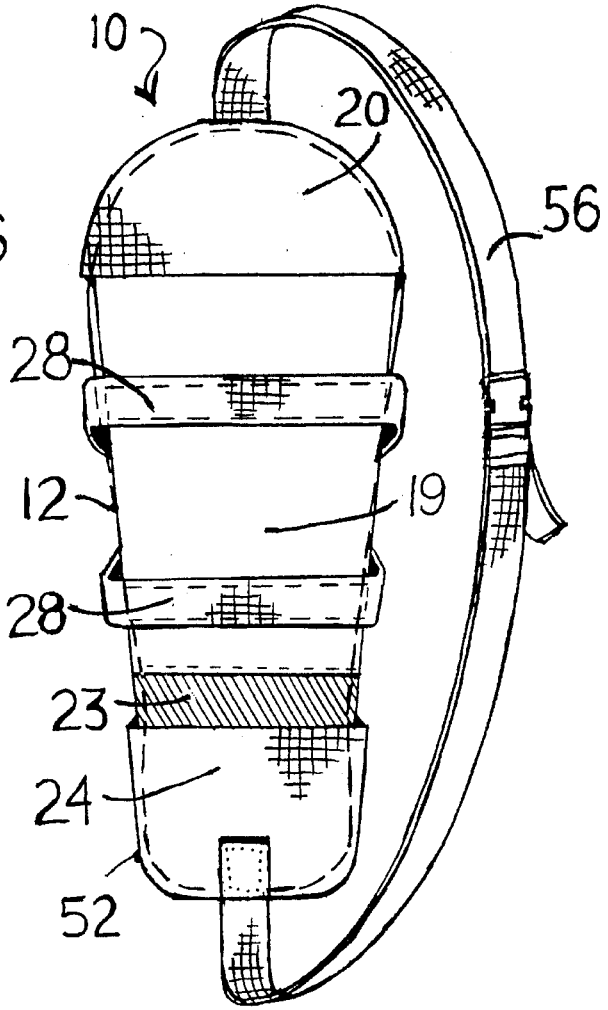
FIG. 4 is a perspective rear view of the carrier case in FIG. 1.

A variety of designs are available with respect to the placement of the zipper 64 and the waist band 66. As illustrated in FIGS. 3 and 5, the zipper 64, waist band 66 and shoulder strap 56 can be provided on the outside of the second engagement means 24. However, as illustrated in FIGS. 1 and 2, the zipper 64 and waist band 66 are provided on the inside of the second engagement means 24 such that the second engagement means 24 must be turned inside out before it is used as a carrier pouch 32. This design allows the shoulder strap 56 to be placed completely inside the carrier pouch 32 even after the carrier pouch 32 is sealed or zippered shut. In addition, it retains the waist band 66 inside the second engagement means 24 when the carrier case 10 is being used to carry a recreational board 11.

The same concept described with respect to the carrier case 10 for the skateboard 11 in FIG. 1 is also applicable to a carrier case 10 for a snowboard or surfboard. For example, as illustrated in FIGS. 6–9 a carrier bag 10 for a snowboard 11 is shown in a carrier case almost identical to the skateboard carrier case. (The numerals used to identify the elements in the skateboard carrier case are also used to identify like elements in the snowboard carrier case.) The primary difference is that the carrier case for snowboard carrier case is larger to accommodate the larger recreational board. Thus, using the same concepts the carrier case can be adapted to carry a surfboard or any size recreational board.

Another difference with respect to the snowboard carrier is the size of the carrier pouch 32 (FIG. 7). Since the carrier case 10 for a snowboard is much larger than the carrier case for the skateboard, the carrier pouch 32 must also be larger to accommodate the additional material. Rather than resembling a fanny pack as in FIG. 2, the carrier pouch 32 in FIG. 7 is more like a knapsack. In addition, the snowboard carrier case 10 is designed so that the user can carry the snowboard on her back. A pair of shoulder straps 56 are provided on the back of the base 12 having respective first ends 70 located in the midsection 16 generally closer to the distal end 18 of the base 12 rather than the proximate end 14 of the base 12. One convenient position to locate the first ends 70 of the shoulder straps 56 is on the back of the base 12 opposite the inner edge 54 of the second engagement means 24. Respective second ends 72 of the shoulder straps 56 are detachable having a connecting means 74 thereon such as a buckle, snap mechanism, or the like that can mate or lock interchangeably with a mating connecting means 76, 78 located on the back of the base 12 in various positions. The connecting system illustrated in FIG. 9 has a first pair of respective male connecting members 76 located at the distal end 18 of the base 12 and a second pair of male connecting members 78 positioned or located generally in the midsection of the base 12 above the first ends 70 of the shoulder straps 56. A pair of female connecting members 74 are provided on the shoulder straps 56 for engagement with either pair of male connecting members 76, 78. Thus, when the recreational board is encased in the carrier case 10 the female connecting members 74 are respectively attached the second pair of male connecting members 78 so that the middle of the board will be comfortably positioned and balanced on the user's back. When the carrier bag 10 is folded into the second engagement means 24 or carrier pouch 32, the female connecting members 74 are respectively attached to the first pair of male connecting members 76 so the knapsack will be comfortably positioned or balanced on the user's back.

Thus, a carrier case for a recreational board is disclosed which will comfortably hold a recreational board so that it can be carried on the user's shoulder or back leaving his or her hands free and, when not in use, fold into itself so that it can be carried around the user's waist or on the user's shoulder or back. The carrier case disclosed will allow the skateboarder or snowboarder skate or ski while carrying the carrier case and other relevant accessories safely on the user's back while leaving his or her hands free to help retain his or her balance. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A carrier case for carrying a recreational board comprising:

a flat base having a face side for contacting a recreational board, a back side opposite the face side, a proximate end substantially shaped to coincide with a proximate end of a recreational board, a distal end substantially shaped to coincide with a distal end of the recreational board, and a midsection connecting the proximate end and the distal end of the base;

a first engagement means secured to the proximate end of the base, said first engagement means having an opening to receive the proximate end of the recreational board;

a second engagement means secured to the distal end of the base, said second engagement means having an opening to receive the distal end of the recreational board or to receive a portion of the proximal and of the base when it is folded;

a third engagement means secured to the midsection of the base, said third engagement means having an opening to receive a midportion of the recreational board;

a first attachment means connected to the base and generally located between the proximate end of the shoulder strap and the proximate end of the base;

a second attachment means connected to the base and generally located at the proximate end thereof; and at least one shoulder strap having a proximate and connected to the face side of the base generally between the second engagement means and the proximate end of the base and a distal end which can be selectively connected to said first or second attachment means.

* * * * *